United States Patent [19]

Rimsa

[11] Patent Number: 4,745,837

[45] Date of Patent: May 24, 1988

[54] INTERNALLY ILLUMINATED ELECTRIC GUITAR

[76] Inventor: Daniel P. Rimsa, 140 Danube Ave. #2, Tampa, Fla. 33606-3524

[21] Appl. No.: 4,159

[22] Filed: Jan. 16, 1987

[51] Int. Cl.[4] ..... G10D 3/00

[52] U.S. Cl. ..... 84/291; 84/164 A

[58] Field of Search ..... 84/291, 293, 464 A, 84/477

[56] References Cited

U.S. PATENT DOCUMENTS 4,236,191 11/1980 Martinez ..... 84/464 A 4,563,933 1/1986 Kim ..... 84/267

OTHER PUBLICATIONS

Jas Obrecht, Guitar Player, Mar. 1986, pp. 56, 57, 58, 61, 62, 64, 66, and 133.

*Primary Examiner*—L. T. Hix

*Assistant Examiner*—Brian W. Brown

[57] ABSTRACT

Electric guitars in present form are machined from solid blocks of various materials then coated with opaque paints that upon curing yield a guitar with a singular, permanent appearance. If the guitar were cast in a mold and transparent plastic resin used as a base material a multiplicity of appearances could be attained with one guitar. Internal illumination sources can be imbedded throughout the various layers of the guitar and when actuated by either the performer or a remote technician the appearance of the guitar can be changed during a performance. Illumination sources can change the color of the guitar by emitting different colors, imply motion by sequential flashing, create line sculptures, and relay video information to the performer.

My invention, The Internally Illuminated Electric Guitar, makes the appearance of the guitar an internal property that is variable and controllable. In addition many manufacturing benefits are realized due to reduced manufacturing steps and reduced production time.

2 Claims, 3 Drawing Sheets

INTERNALLY ILLUMINATED ELECTRIC GUITAR

My invention relates to solid body electric guitars.

The Internally Illuminated Electric Guitar is a solid body guitar molded of transparent thermosetting plastic resin with illuminating sources embedded throughout the body. Illuminating sources include light emitting diodes (LEDs), injection laser diodes, flat screen televisions, xenon strobe tubes, liquid crystal displays, and incandescent light bulbs. The main innovations are the ability to change the appearance of the guitar during a performance by switching different light sources on and off, yielding different colors and motion, and the manufacturing process using thermosetting plastic resin cast in a mold as opposed to machining blocks of wood, thermoplastic acrylic, or metal.

All contemporary solid body electric guitars employ wood or metal as base materials which must be cut from large blocks and machined extensively in order to produce the desired structure. In addition wood and metal are opaque and the appearance of the guitar is permanent once the finish treatment has set. A few guitars were produced in the late 1960's with clear acrylic bodies machined from sheets of acrylic. These guitars were clear, had no internal illumination, and were machined, not cast in a mold as is my invention. By activating the various light circuits of the Internally Illuminated Electric Guitar the color may be changed, motion implied by sequential flashing of lights, and information may be relayed to the performer on flat screen televisions or liquid crystal displays.

Control of the lighting circuits is accomplished by a group of switches on the rear of the guitar for control by the performer and remote control is attained by electrical pulses fed into the guitar through the output interface port. Remote control allows the performer to concentrate on his performance while a technician coordinates the appearance of the guitar to stage lighting and to other performers instruments.

String vibration is detected using electro-magnetic pickups with volume and tone controls mounted on the face of the guitar. A wooden neck with tuning machines mounted past the nut is bolted to the body. A tunable bridge with stud supports sunk into the body is mounted on the face of the guitar. All sound and light signals are terminated at the output interface port on the rear edge of the guitar for connection to amplifiers and remote light activation switching equipment.

Producing guitars from molded thermosetting plastic resin results in many manufacturing benefits. When cast in a smooth mold the body requires a minimal amount of polishing to yield a finished product as opposed to the many hours of machining and sanding that wood or metal require. Painting and finish coatings are eliminated altogether as pigments may be mixed into the resin for any desired color and finish coatings are not required on plastic bodies. Molded guitars not only require less manufacturing procedures, thereby reducing production time, but are less expensive to produce as well. One mold can yield many thousands of guitars adding uniformity to the production process.

DESCRIPTION OF DRAWINGS

There are five drawings following to show various views of the guitar and remote control switching box.

DESCRIPTION

With reference to the acompanying drawings I will now describe my invention.

Figure 1:
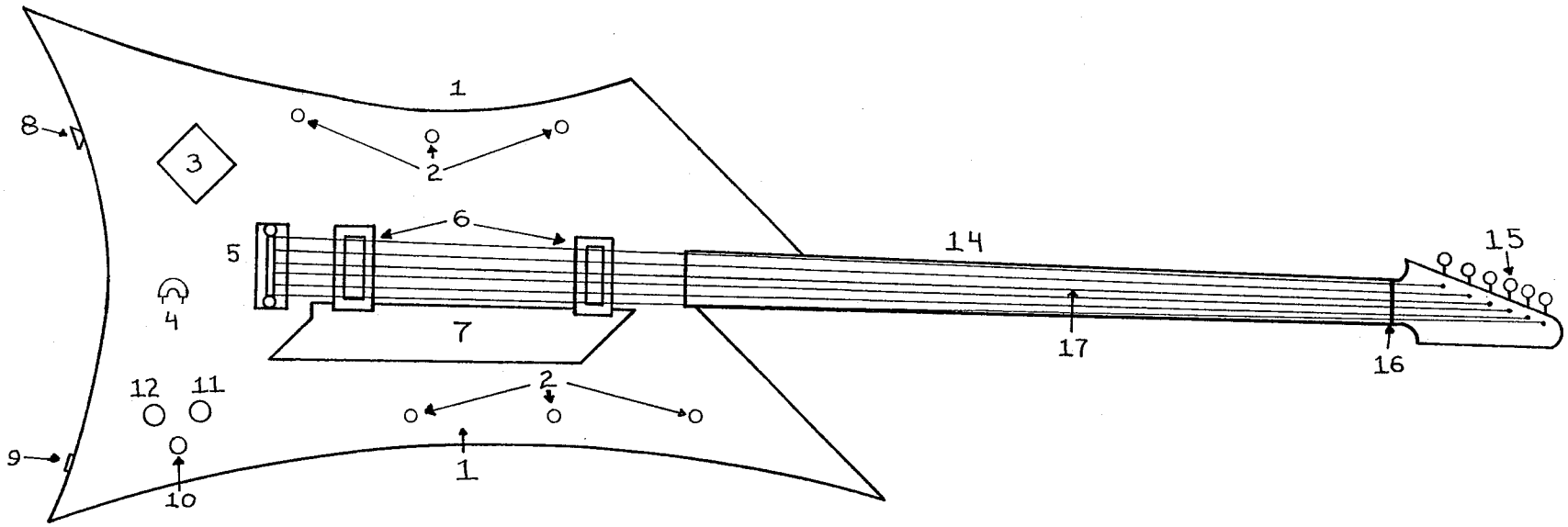
FIG. 1 is a front view of the guitar showing the face of the guitar, neck, strings, and hardware.
Figure 4:
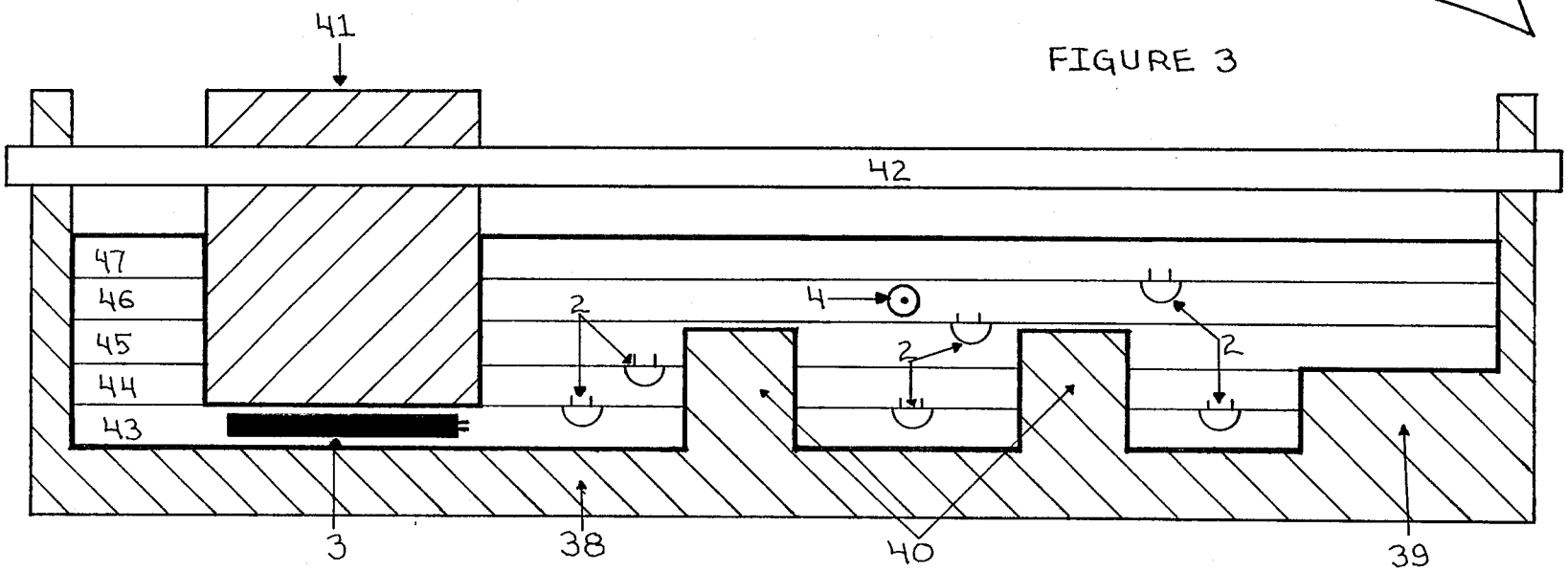
FIG. 4 is a cross section of the mold used in production of the guitar.

FIG. 1 shows the face of the guitar as viewed away from the performer. The body 1 is composed of transparent thermosetting polyester resin having been cast in a mold 38 (FIG. 4). Since the base material of the body is transparent, light may pass through it, and light sources imbedded in the body will be visible to the audience and performer. By using many light sources with different positions and colors the appearance of the guitar may be changed radidly to accompany stage settings, stage lighting, and other performers instruments.

Figure 2:
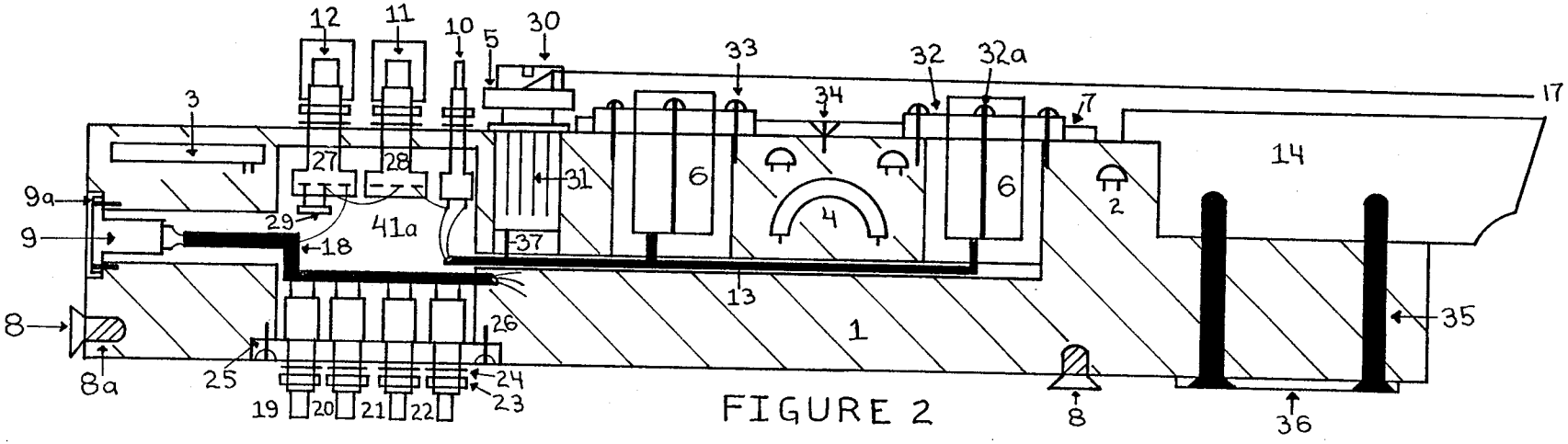
FIG. 2 is a cross section of the guitar body showing all the components of the body.
Figure 3:
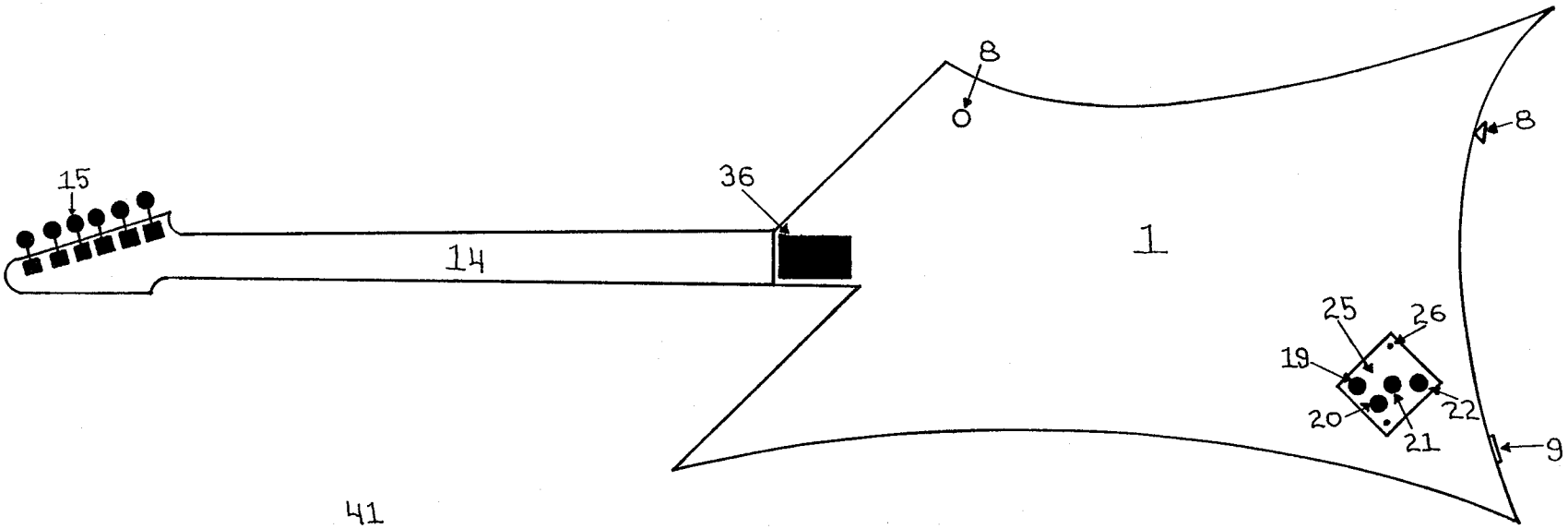
FIG. 3 is a rear view of the guitar showing the back of the guitar and neck.

The principles behind playing the guitar and the sound generation of the guitar follow typical designs. A wooden neck 14 is bolted 35 (FIG. 2) to the body 1 through a metal neckplate 36 to distribute screw torque evenly. Ferromagnetic strings 17 are suspended between a tunable bridge 5 and the nut 16. Geared tuning machines 15 allow pitch variation of the strings to facilitate proper tuning. The bridge is held to the face of the guitar by bridge studs 30 which are threaded and screw into bridge stud inserts 31 that are sunk into holes drilled into the body. A tunable bridge is used to set proper string intonation and to allow string height adjustment.

Two electro-magnetic pickups 6 are suspended below the strings by pickup rings 32 which are attached to the body by screws 33. Pickup ring screw **32*a* threads into the bottom of the pickup and will raise or lower the pickup as it is rotated. The output signal of the pickups is routed into the control cavity 41*a* via output signal cable 13. Volume and tone of the guitar are adjustable by the performer by using the pickup selector switch 10, the volume knob 11, and the tone knob 12. Pickup selector switch 10 allows a choise of either pickup signal or both in parallel. Volume is controlled by potentiometer 28 and tone is controlled by potentiometer 27 which varies tone by shunting high frequencies to ground through tone capacitor 29. Output signal is routed to output interface jack 9 via output signal and light control cable 18**.

A replaceable transparent pickguard 7 is secured to the body by screws 34 to prevent plectrums from scratching the body. Strap buttons 8 are secured to the body with screws **8*a*** so a performer may play the guitar standing up.

Figure 5:
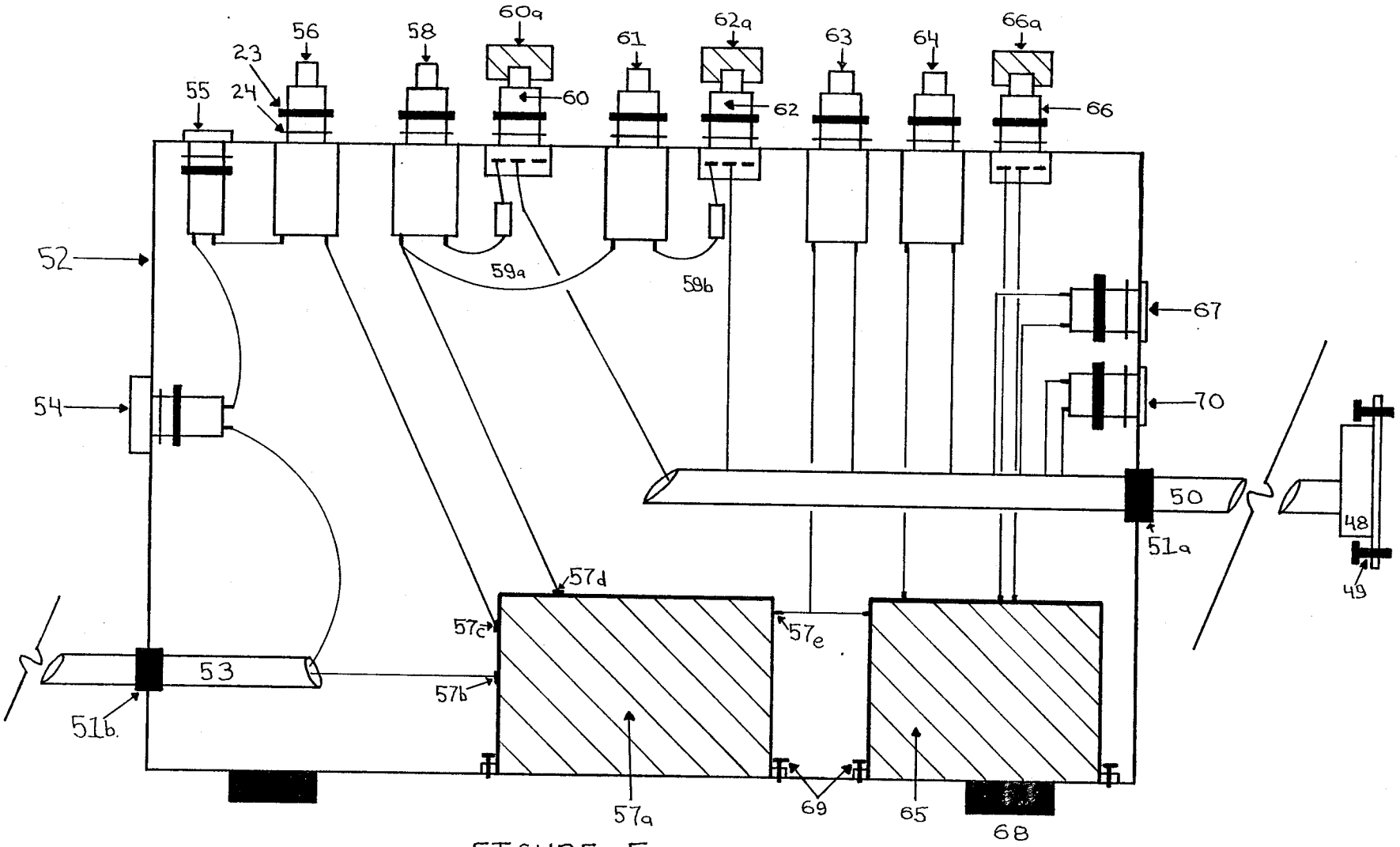
FIG. 5 is a cross section of the remote control switching box, output interface cable, and output plug.

Control of internal illumination sources is accomplished in one of two ways; by onboard switches, and by use of remote control switch box 52 (FIG. 5). Switches 19, 20, 21, and 22 on backplate 25 allow the performer control of illumination sources. Switch 19 controls LED circuit 1, switch 20 controls LED circuit 2, switch 21 controls the flat screen television, and switch 22 controls the xenon strobe tube. With all remote control switches 58 (LED circuit 1), 61 (LED circuit 2), 63 (flat screen television), and 64 (xenon strobe tube) turned on the onboard light control switches are enabled allowing the performer control of all internal light sources.

In order to allow the performer to concentrate on the musical passage being played remote operation of internal illumination sources is attained by turning all onboard light control switches (19, 20, 21, and 22) on and using remote control switches 58, 61, 63, and 64. With the remote operation feature many instruments may be controlled by a technician to blend with stage settings and other instruments.

Power for the internal illumination sources is supplied by remote control switching box 52 through output interface cable 50. The output interface plug 48 is plugged into output interface jack 9 connecting internal circuitry to the remote control switching box. The remote control switching box converts 110 volt alternating current into direct current for powering illumination sources, allows remote control of illuminating sources, connects to video input signals for the flat screen television, and connects to pickup output signals for routing to amplifiers.

Alternating current power from a 110 volt socket is routed into the remote control box 52 by cable 53. A strain relief 51*b* is installed to prevent damage to the cable. A.C. power is routed to the fuseholder 54, neon glow lamp 55, on/off switch 56 and finally to the direct currnet power supply 57*a*. The D.C. power supply converts 110 volt A.C. to +5 volts D.C. 57*d*, and +12 volts D.C. 57*e*. LED circuits are powered with +5 volts and the flat screen television and xenon strobe tube by +12 volts. Switch 58 turns LED circuit 1 on and off, resistor 59*a* limits current to a safe level for the LEDs. Potentiometer 60 varies the brightness of LED circuit 1 by rotating knob 60*a*. The wiper of potentiometer 60 is routed to the output interface cable 50 for connection to the guitar. LED circuit 2 is controlled in a similar fashion by switch 61, resistor 59*b*, and potentiometer 62.

Switch 63 turns the flat screen television on and off by interupting the +12 volt power routed to it. Switch 64 turns the xenon strobe tube on and off, flashrate is varied by rotating knob 66*a* mounted on potentiometer 66. The transformer and capacitor needed to flash the xenon strobe tube are housed in box 65. The D.C. power supply 57*a* and the xenon strobe tube transformer and capacitor box 65 are secured to the bottom of the remote control switching box with screws 69. Rubber feet 68 prevent the remote control switching box from scratching any surfaces the box may be laid upon.

All switches, jacks, the fuseholder, and any potentiometers on the guitar and remote control switching box are secured by a washer 24 and a nut 23. The washers and nuts are shown but not numbered in every application to simplify the drawings.

Sound output is routed to jack 70 which can be connected to amplifiers. Video input jack 67 connects external video recorders and/or video generators to the flat screen television. All light and sound signals run to the guitar via output interface cable 50. A strain relief 51*a* is installed where the cable exits the remote control switching box to prevent cable damage. At the end of the cable is the output interface plug 48 which plugs into the rear edge of the guitar at output jack 9. Screws 49 secure the plug to the jack to prevent accidental separation during performances. Conductors of output interface cable 50 are soldered to the appropriate pins of output interface plug 48 to enable onboard and remote circuitry to interact.

I will now describe in detail the manufacturing process.

The first step is to design the desired shape of the guitar in full scale drawings. All internal and external hardware must be selected before the design phase as the mold 38 must be planned around the dimensions of the hardware. When the initial drawings are finished all dimensions must be enlarged by 2–3% to account for shrinkage that results as the resin cures. The finalized drawings are used to build the mold 38 which may be made of either steel or fiberglass. Fiberglass works well and is less expensive than steel but if very large production runs are planned steel would be prefered due to its durability.

The mold is constructed so that the bottom of the mold corresponds to the face of the guitar. As resin is poured into the mold the guitar forms from front to back. The edge of the mold should be 1 inch higher than the desired thickness of the body to allow holes drilled for dowels 42 from which items may be suspended into the mold.

To eliminate the need for routing holes for pickups, controls, and the neck the mold has bulges in the desired shape of the cavity to displace resin and yield a hollow cavity when the body is released from the mold. A bulge for the neck 39 and bulges for the pickups 40 are built into the bottom of the mold. A cavity for controls and switches is attained by suspending a box 41 from a dowel 42 run through the edges of the mold. This results in a solid face on the guitar with a hollow cavity that can be accessed through the backplate 25. The backplate is secured to the back of the body with screws 26. Control cavity 42*a* houses all onboard switches and potentiometers.

The final preparatory step is to clean the mold and ascertain that all surfaces that will come in contact with the resin are smooth. The degree of smoothness will determine how much polishing will be necessary after the guitar is cast, the smoother the mold is the smoother the body will be and production time will be reduced. lhe mold and any suspended boxes will be coated with mold releasant wax to ease removal of the finished body from the mold. The mold should be made level with respect to the ground.

All items to be imbedded in the first layer must be positioned and suspended from the support dowels. LEDs 2, a flat screen television 3, and xenon strobe tube 4 are shown in the drawings, many other illumination sources are available such as injection laser diodes, liquid crystal displays, and incandescent light bulbs. To simplify the drawings only three illumination sources are shown as the operation of the omitted items is very similar to the depicted items. Power wires for all onboard illumination sources should be routed to the control cavity box 41 so when the body is released from the mold wire ends will be easily accessed for soldering. Care should be taken to avoid short circuits.

The resin is now prepared by mixing desired coloring pigments and catalyst. Polyester resin is poured from storage container into a clean beaker and pigments added until the desired hue is attained. Layers may be clear, tinted slightly, or made fully opaque depending on the amount of pigment mixed into the resin. Catalyst is added and thoroughly blended until the mixture is homogeneous. Mixed resin is poured into the mold to a depth flush with the rear of the items to be imbedded in the first layer 43. The resin must cure until thoroughly hard, this will depend on the particular resin and the amount of catalyst added. For proper curing the amount of catalyst used should follow the recommendation of the resin manufacturer.

Once the first layer has hardened items imbedded are cut from suspending members and the second layer prepared by suspending the items to be imbedded in it form the support dowels 42. As in the first layer power wires must be routed to the control cavity box for future connection. Resin for the second layer is mixed with apprpriate coloring pigments and catalyst added. The resin is poured into the mold to a depth flush with the rear of the items to be imbedded in layer 44. The resin is allowed to cure until hard and suspending members cut away from imbedded items.

This procedure is repeated until the body reaches the desired thickness 45, 46, and 47. By alternating colors of resin and light sources a variety of images can be built into one guitar. Pouring a guitar layer by layer also minimizes the chances of the body cracking in the mold by reducing the amount of heat emitted during the curing process. It also free the technician to prepare light systems for subsequent layers. When the first and last layers are poured the pickguard 7 and backplate 25 are poured into separate smaller molds. Using the same resin batch as the layers the items will be secured to ensures a perfect color match.

When the final layer has cured the support dowels 42 are removed from the edge of the mold and the control cavity box 41 removed from the body. The mold is flipped over and the body knocked loose of the mold. This should be done on a soft surface to prevent scratching the body. Any rough or sharp edges are first filed down then sanded with progessively finer sandpaper to blend with body contours.

Holes for attaching hardware are drilled at this point. The neck, pickups, and bridge are aligned and small marks made on the body for proper hole placement. Appropriately sized holes are drilled. Holes must also be drilled for strap buttons 8, backplate 25, pickguard 7, pickup selector switch 10, volume potentiometer 28, tone potentiometer 27, and output interface jack 9. Placement of these holes is not critical so long as no internal power wires are severed.

A small hole is drilled from the control cavity to the bridge pickup cavity and from there to the neck pickup cavity for routing of output signal cable 13. Another small hole is drilled to the lower bridge stud insert 31 form the control cavity for routing the bridge ground wire 37.

The body is polished on a lambswool buffing wheel spun by a bench mounted grinder. Polishing compound is added to the lambswool to give enough abrasion for proper polishing. All external surfaces are polished until very smooth and shiny.

All external hardware is now installed including; neck 14, pickups 6, strap buttons 8, pickup selector switch 10, volume potentiometer 28, tone potentiometer 27, and bridge 5. Pickup output signal wires are pulled through the previously drilled holes into the control cavity. The wires are soldered to the pickup selector switch, volume potentiometer, tone potentiometer, and terminated at the appropriate pins of the output interface jack.

Power wires for the various internal illumination sources are soldered to the appropriate switches on the backplate and terminated at the output interface jack. The output interface jack is slipped into the previously drilled hole and secured with screws 9*a*.

The guitar is now strung and tuned. Bridge and neck adjustments are made for best playability and correct intonation. The body is cleaned with plastic cleaner to remove any fingerprints or dust acquired during assembly.

The guitar is connected to the remote control switching box 52 by plugging output interface plug 48 into output interface jack 9. Sound output jack 70 is connected to an amplifier and video input jack 67 conne to a video recorder. Remote control switching box 52 is plugged into a 110 volt A.C. socket via cable 53. Power is applied to the guitar and all light and sound systems tested. When it is ascertained that all systems are functioning correctly the guitar is complete.

I claim:

1. An internally illuminated electric guitar, comprising:

(a) an electric guitar with body cast of solid transparent plastic resin consisting of:
  (1) multiple layers of optically clear plastic resin,
  (2) multiple layers of optically clear plastic resin tinted with colored dyes,
  (3) alternately tinted layers of transparent plastic resin;

(b) a multiplicity of internal illumination sources encased in the transparent body such that:
  (1) said illumination sources are an integral part of the guitar body,
  (2) said illunination sources are encased at various depths throughout the guitar body,
  (3) light emitted from said sources is distributed throughout the entire volume of the guitar body;

(c) electronic circuitry and interconnections necessary to activate said internal illumination sources.

2. The apparatus as recited in claim 1, wherein said internal illumination sources consist of:

(a) light emitting diodes;
(b) Xenon strobe tubes; and
(c) a flat screen television.

* * * * *